US005887362A

United States Patent [19]

McKenzie

[11] Patent Number: 5,887,362

[45] Date of Patent: Mar. 30, 1999

[54] SNOWSHOE REAR CLEAT ASSEMBLY

[75] Inventor: Mary M. McKenzie, Rocklin, Calif.

[73] Assignee: Pride Industries, Inc., Sacramento, Calif.

[21] Appl. No.: 822,310

[22] Filed: Mar. 21, 1997

[51] Int. Cl.[6] ..... A43B 5/04

[52] U.S. Cl. ..... 36/124

[58] Field of Search ..... 36/122–125

[56] References Cited

U.S. PATENT DOCUMENTS 4,720,927 1/1988 Abegg .
5,253,437 10/1993 Klebahn .

OTHER PUBLICATIONS

Atlas Snowshoe Company Brochure—1993.

*Primary Examiner*—Ted Kavanaugh
*Attorney, Agent, or Firm*—John P. Costello

[57] ABSTRACT

A snowshoe rear cleat assembly comprised, in a first embodiment, of a rigid substrate for mounting a rear cleat beneath, the rigid substrate underlapping a conventional rubberized snowshoe decking. The rigid substrate and rubberized decking together function to comprise the entire decking of a snowshoe. This underlapping design serves to cause the rear cleat to protrude a greater distance below the snowshoe frame, thereby allowing the cleat to penetrate a greater depth into snow, for better traction. Additionally, a heel strike plate is designed to prevent slippage of a snowshoer's footwear, and to serve to self-clean the bottoms of the snowshoer's footwear of snow and ice. In an alternate embodiment of the rear cleat assembly, the rigid substrate comprises the entire snowshoe decking and the rear cleat attaches underneath the rigid substrate.

1 Claim, 6 Drawing Sheets

SNOWSHOE REAR CLEAT ASSEMBLY

BACKGROUND OF THE INVENTION

1. Field of the Invention

This invention pertains to snowshoeing and, more specifically, to an assembly for rigidly mounting a rear cleat upon a snowshoe, as well as a snowshoe incorporating such an assembly.

2. Description of the Background Art

Snowshoe rear cleats are designed to bite into snowy and icy surfaces to prevent slippage of the rear portion of a snowshoe. Consequently, it is important for a snowshoe rear cleat to be mounted rigidly, so that a strong bite into snow and ice can occur. If the rear cleat is mounted loosely so that it travels, or floats about, rather than addressing the ice in a consistent and rigid attitude, then slippage will occur, possibly causing injury to the snowshoe occupant.

Snowshoe cleats must also extend below the snowshoe frame a sufficient depth to allow the cleat members to gain purchase upon a snowy and icy surface. By extending the individual cleat members a sufficient depth below a snowshoe's frame, it is more likely that a good "bite" upon a slippery surface will be achieved, and likewise, good traction will result. The importance of good traction becomes paramount during steep climbs and descents, where the likelihood of slippage is greatest.

A popular method of attaching a rear cleat to a snowshoe is seen in U.S. Pat. No. 5,440,827, issued to Klebahn et al., and an accompanying brochure distributed by Atlas Snowshoe Company. In these references, the rear clear is comprised of a center portion having individual cleat members depending down from, and perpendicularly attached to, a center portion. The rear cleat is attached to a snowshoe by cutting holes in a patch of snowshoe decking material and placing the cleat members in a manner such that they depend downward through the holes cut into the patch of decking material. The patch of decking material is then sewn and riveted onto the main snowshoe decking web, for stability.

This prior art design uses the rubberized decking material as a substrate, wherein the rear cleat is held fast within two layers of decking material in a type of "sandwich" design. A drawback of this design regarding traction occurs because the center portion of the rear cleat is positioned atop a layer of decking material, rather than beneath it. This design therefore elevates the cleat upward into the snowshoe frame and thereby lessens the depth of penetration for a snowshoe rear cleat, having standard-length cleat members.

Alternately, if the rear cleat is placed beneath the rubberized decking material and mounted thereon, the rear cleat becomes unstable, because the stabilizing effect acquired from sandwiching between two layers of decking material is lost. The only option for achieving a sufficient depth of penetration with this prior art design is to lengthen the cleat members, which would correspondingly increase the weight of the snowshoe.

In one embodiment, the snowshoe rear cleat assembly which is the present invention causes the individual cleat members to extend a greater depth beneath the snowshoe frame than heretofore achieved, without necessitating the lengthening of the individual cleat members. In a second embodiment of the invention, the rear cleat is attached to the snowshoe decking in a simplified manner, thereby facilitating ease of manufacture. In both embodiment of this invention, the use of the "sandwiching" design present in the prior art, for stabilizing the rear cleat, is avoided.

Accordingly, the foregoing patents and other information reflect the state of the art of which the inventor is aware, and is tendered with a view toward discharging the inventor's acknowledged duty of candor in disclosing information which may be pertinent with regards to the patentability of the present invention. It is respectfully stipulated, however, that the disclosed information does not teach or render obvious, singly or when considered in combination, the inventor's claimed invention.

SUMMARY OF THE INVENTION

By way of example, and not of limitation, the present invention generally pertains to a snowshoe rear cleat assembly comprised of a rigid decking material which acts as a substrate for attaching the rear cleat to a snowshoe. In a first embodiment, the rigid substrate is coupled to the main flexible rubberized decking material, in an underlapping manner, by common means, such as rivets. The rear cleat is then coupled directly beneath the rigid substrate. The rigid substrate provides a stable mounting surface for the rear cleat, and since the center portion of the rear cleat is mounted beneath the rigid substrate, and not on top of it, the cleat members are allowed maximal extension.

In a second embodiment of the invention, the rigid substrate does not underlap the rubberized decking, but instead serves as the entire decking of the snowshoe. This embodiment has the advantage of providing a rear cleat assembly that is extremely easy to manufacture.

Additionally, a gripping and self-cleaning heel strike plate is presented which has a gripping and self-cleaning design for gripping and cleaning a snowshoer's footwear. Alternately, a unitary structure having similar gripping and self-cleaning features is presented for improving prior art rear cleat assemblies which use a rigid substrate for a decking material.

Accordingly, this invention will be more fully understood through the following objects and advantages:

An object of the invention is to provide a snowshoe rear cleat assembly which achieves maximal extension for the individual rear cleat members, thereby increasing the depth of penetration of the rear cleat members into snow and ice.

Another object of the invention is to provide a snowshoe rear cleat assembly which achieves superior traction.

Another object of the invention is to provide a snowshoe rear cleat assembly of exceptional stability.

Another object of the invention is to provide a snowshoe rear cleat assembly which does not "sandwich" the rear cleat between layers of rubberized decking material.

Still another object of the invention is to provide a snowshoe rear cleat assembly that is rigidly attached, but easy to manufacture.

Further objects and advantages of the invention will be brought out in the following portions of the specification, wherein the detailed description is for the purpose of fully disclosing preferred embodiments of the invention, without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
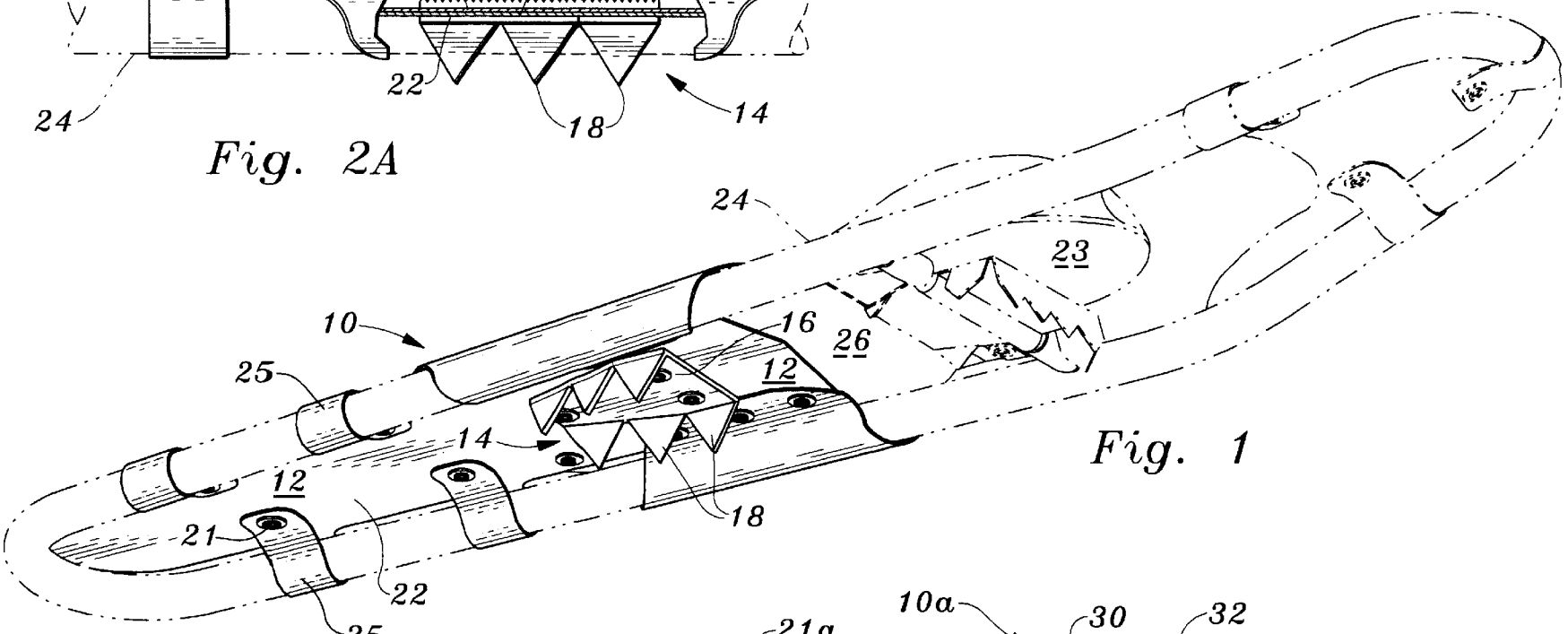
FIG. 1 is a perspective view of the first embodiment of the snowshoe rear cleat assembly which is the present invention, coupled to a snowshoe drawn in phantom.

Referring more specifically to the drawings, the first embodiment of the snowshoe rear cleat assembly, which is the present invention, is shown generally in FIG. 1, incorporated into a snowshoe having a frame and binding. Rear cleat assembly 10 includes a rigid substrate means 12, for attaching rear cleat means 14.

Figure 2A:
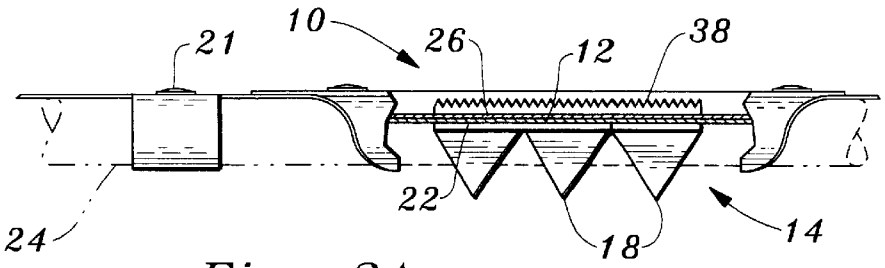
FIG. 2*a* is a side view of the first embodiment, coupled to a snowshoe drawn in phantom. This view is intended to show the maximal extension of the rear cleat members achieved by this embodiment.
Figure 3A:
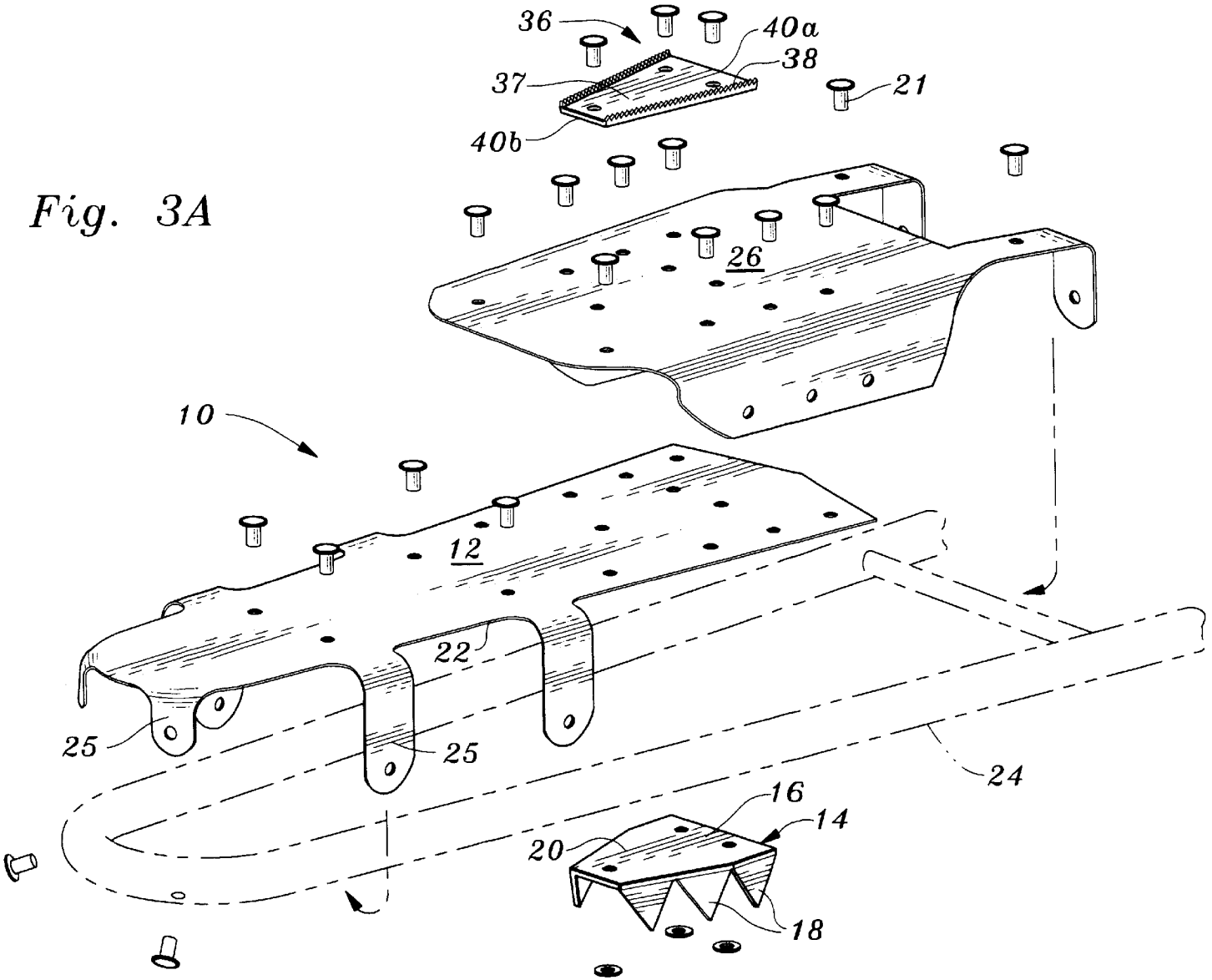
FIG. 3*a* is an exploded view of the first embodiment, shown detached from a snowshoe drawn in phantom.

Referring also to FIGS. 2*a* and 3*a*, rear cleat means 14 has a central portion 16 having a generally planar top surface 20 and cleat members 18, which depend down from central portion 16 in a perpendicular orientation. The generally planar top surface 20 of central portion 16 abuts against, and couples directly to, the undersurface 22 of rigid substrate means 12 by riveting 21, or other means well known in the art.

Rigid substrate means 12 is preferably made from a rigid, but flexible plastic, which is resistant to ice and snow buildup. Of course, other rigid materials could be used, such as sheet metal. Rigid substrate means 12 forms a web which spans across the rear portion of snowshoe frame 24 behind binding 23. As seen in FIG. 1, at various points 25, rigid substrate means 12 is coupled around snowshoe frame 24 with rivets 21, or other coupling means . The front portion of rigid substrate means 12 underlaps and abuts against the rear underside of decking material 26. Decking material 26 is typically a flexible, waterproof, rubberized material, such as Hypalon®. Rigid substrate means 12 is preferably riveted to decking material 26 in underlapping fashion, thereby forming a substantially uniform structure.

Figure 2B:
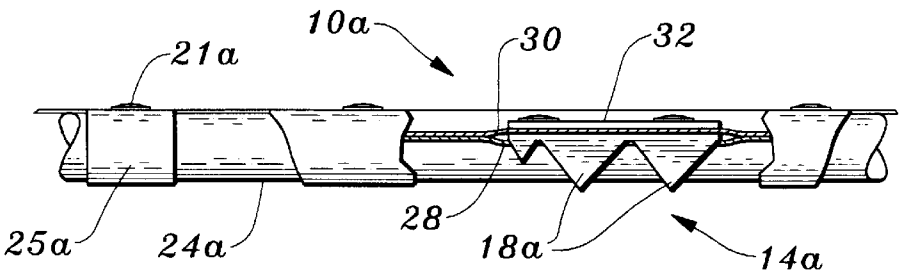
Fig. 2B (Prior Art)
FIG. 2*b* is a side view of a prior art snowshoe rear cleat assembly employing a "sandwich" design. When compared to the first embodiment shown in FIG. 2*a*, it is apparent that the similar-length prior art rear cleat members extend a shallower depth below the snowshoe frame.

FIGS. 2*a* and 2*b* represent sideviews of the first embodiment of the present invention 10, and the prior art snowshoe rear cleat assembly 10*a*, respectively. A comparison of these sideviews shows that with cleat members 18, 18*a* having equivalent length, the present invention results in cleat members 18 extending a greater distance below snowshoe frame 24 when compared to the prior art 18*a*, 24*a*. This greater extension of cleat members 18, achieved by the present invention, results in a greater depth of penetration into snow or ice, thereby achieving greater traction.

Figure 3B:
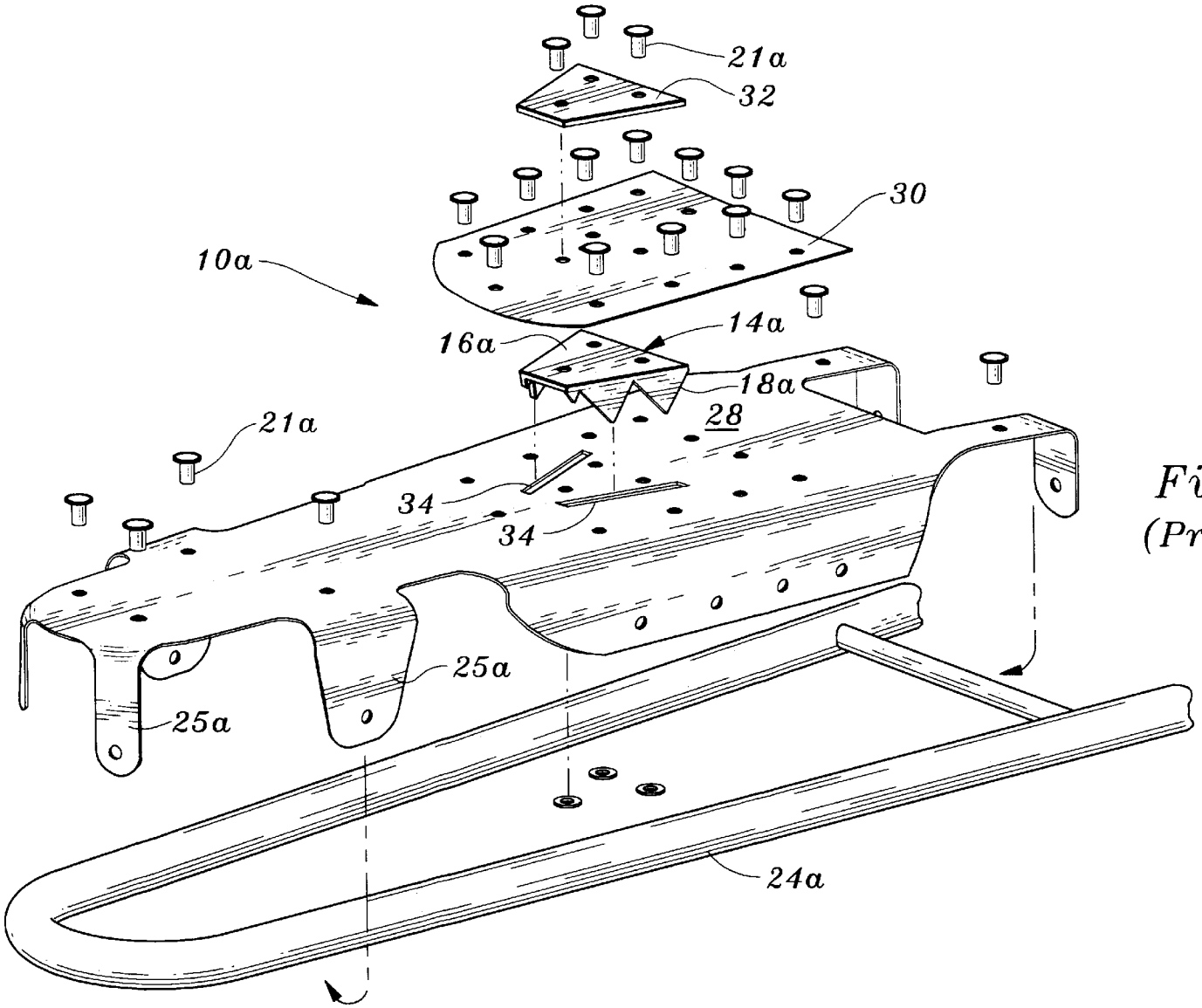
Fig. 3B (Prior Art)
FIG. 3*b* is an exploded view of the prior art snowshoe rear cleat assembly.
Figure 4A:
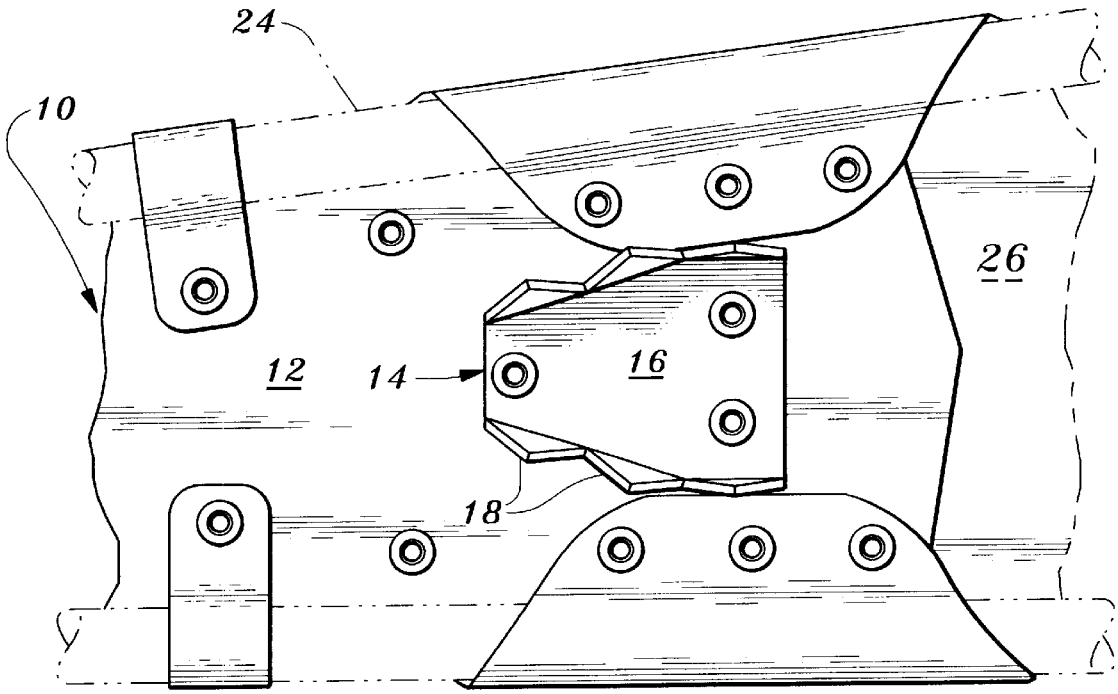
FIG. 4*a* is a bottom view of the first embodiment coupled to a snowshoe drawn in phantom.
Figure 4B:
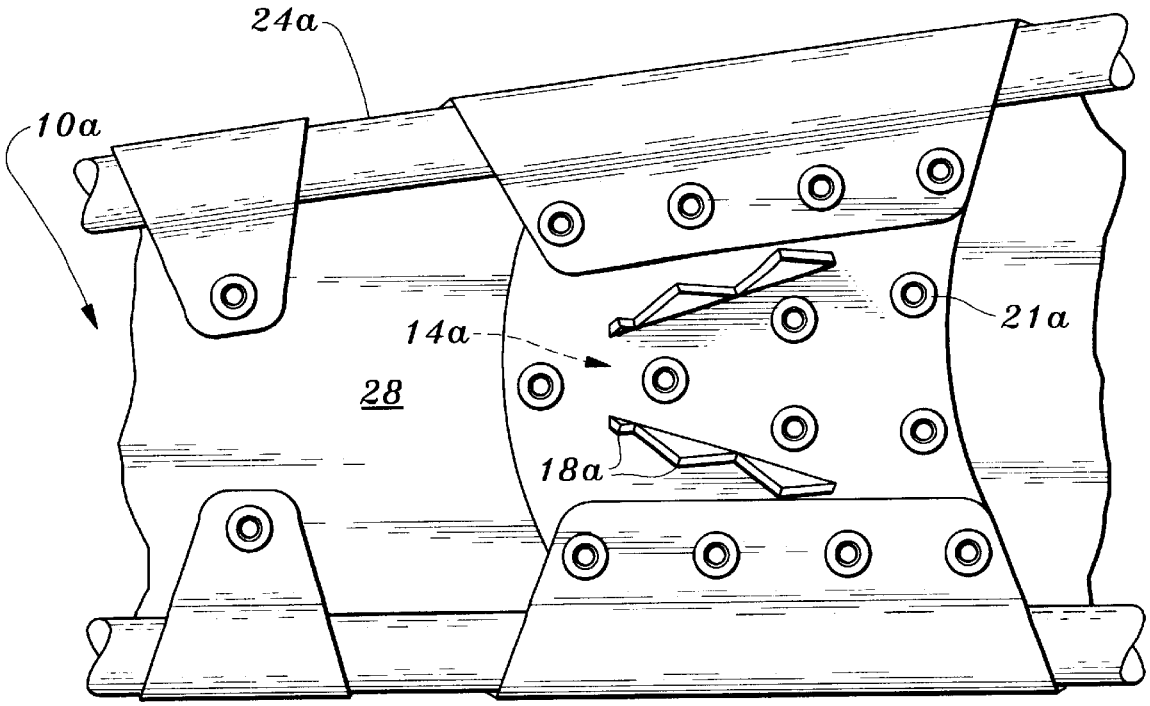
Fig. 4B (Prior Art)
FIG. 4*b* is a bottom view of the prior art snowshoe rear cleat assembly.

FIGS. 3*b* and 4*b* represent an exploded view and a bottom view of the prior art snowshoe rear cleat assembly 10*a*, respectively. Here, in FIG. 3*b*, it can be seen how the central portion 16*a* of rear cleat means 14*a* is "sandwiched" between two pieces of rubberized snowshoe decking material 28, 30. The main decking 28 is coupled to the snowshoe frame 24*a*. Decking patch 30, is also comprised of rubberized decking material, such as Hypalon®. Decking 28 is penetrated by cleat members 18*a* which depend downward through holes 34 in decking 28. The central portion 16*a* of rear cleat means 14*a* is sandwiched between the main decking material 28 and decking patch 30. Finally, heel plate 32 which sits atop decking patch 30 is riveted 21*a* to central portion 16*a*. Hence, prior art rear cleat assembly 10*a* achieves rigidity by stabilizing cleat members 18*a* in holes 34 of decking 28, and further, by having central portion 16*a* sandwiched between decking material 28, and decking patch 30. Finally, by bonding the assembly to heel plate 32 with rivets 21*a*, a rigid construction is achieved. This assembly requires that central portion 16*a* always be positioned atop decking 28, thereby reducing the amount of downward extension of cleat members 18*a*.

By contrast, in FIGS. 3*a*, and 4*a*, the present invention 10 is shown. Cleat members 18 depend down directly from the central portion 16 of rear cleat means 14, and therefore, are unfettered in their downward extension by decking material 26, or any other layer. The undersurface of rigid substrate means 12 couples directly atop the central portion 16 of rear cleat means 14, thereby allowing for the maximal extension of cleat members 18. Additional downward extension of cleat members 18 is aided by the placement of the front portion of rigid substrate means 12 in an underlapping manner below main decking material 26, which in turn is coupled to frame 24 by riveting 21 or other means known in the art. It is also possible to increase the downward extension of cleat members 18 further by adding shims (not shown) between rigid substrate means 12 and decking material 26, or adding shims (not shown) between the top surface 20 of central portion 16 and the undersurface 22 of rigid substrate means 12.

Rigid substrate means 12 continues rearward of decking material for the remaining length of snowshoe frame 24. Rigid substrate means 12 allows for rear cleat means 14 to be held fast, in a stable manner, without necessitating sandwiching between layers of material, as was practiced in the prior art shown in FIGS. 2*b*, 3*b*, and 4*b*.

Referring again to FIG. 3*a*, heel strike plate 36 is preferably mounted in vertical alignment above rear cleat means 14, and represents an additional improvement incorporated into this invention. Often times, during long snow treks, the bottoms of a snowshoe user's shoes may experience a build-up of snow and ice. This build up may result in the user's heel slipping from side to side, upon contacting the heel strike plate, this slippage resulting in inefficient, awkward steps. In the present invention, heel strike plate 36 is comprised of a substantially planar face 37 having a plurality of upwardly-positioned serrated projections 38 formed in a row along at lease one outside edge of face 37, which help to grip a snowshoe user's heel, and prevent slippage. Additionally, projections 38 aid in clearing snow and ice from the bottoms of a user's shoe, in a self-cleaning fashion, as the user travels across a snowy landscape. The front and back edges 40*a*, 40*b* of face 37 are preferably devoid of projections 38, thereby remaining clear for snow and ice to slide off of face 37, rather than accumulate thereon.

Figure 5:
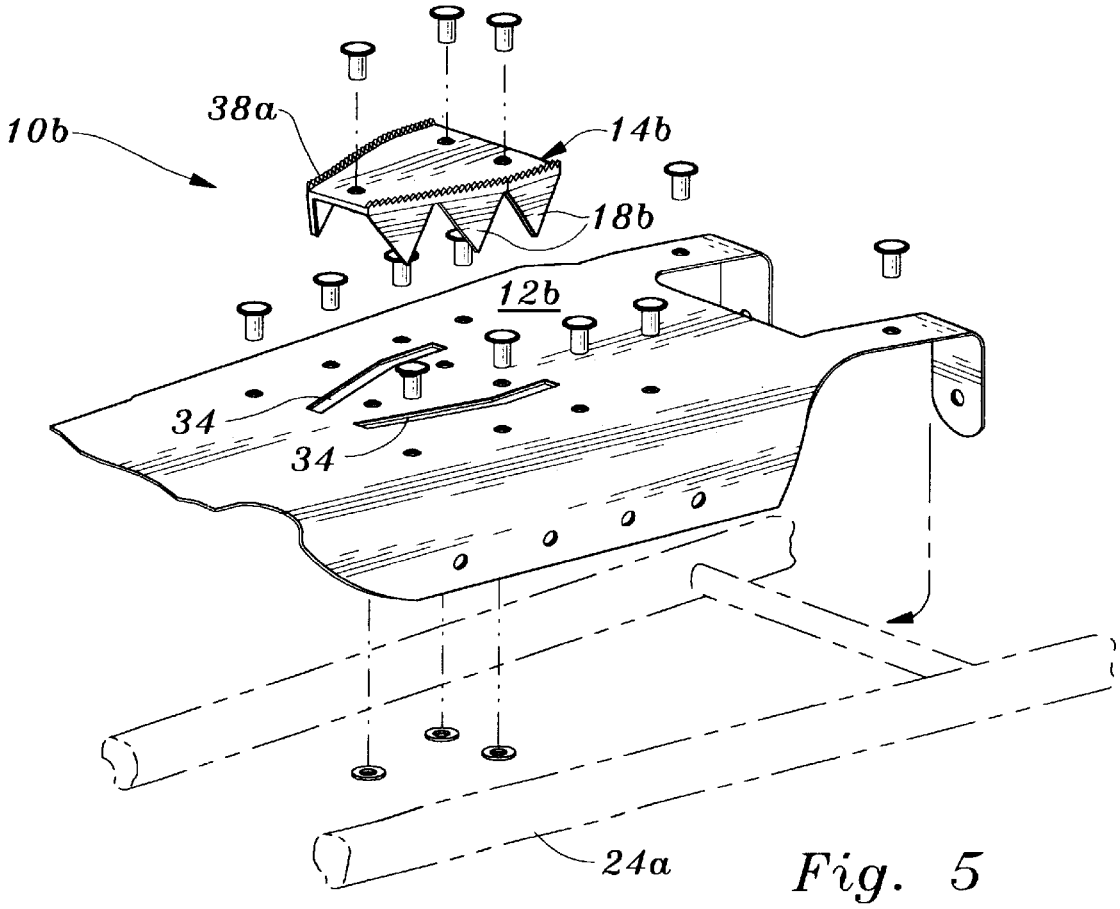
FIG. 5 is an exploded view of a unitary structure incorporating gripping and self-cleaning features for use with a prior art rear cleat assembly.
Figure 6:
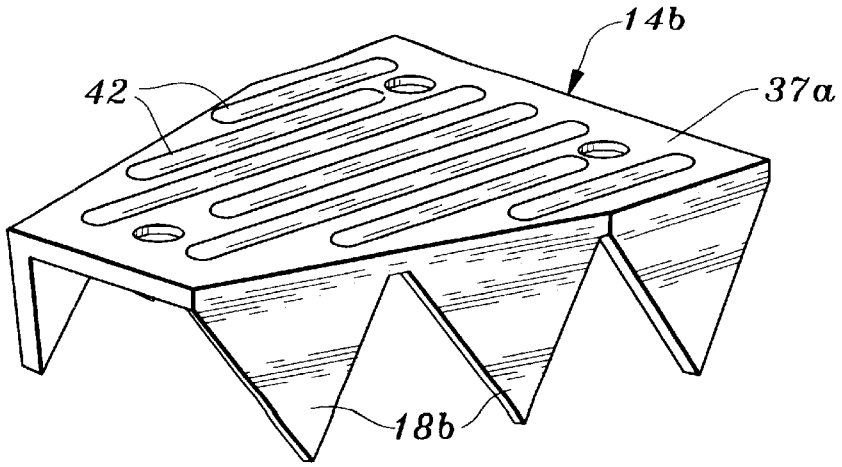
FIG. 6 is a closeup perspective view of an alternate embodiment of the unitary structure showing a gripping and self-cleaning surface comprised of ridges.

In FIGS. 5 and 6, an alternate embodiment for a heel striking surface which combines the features of heel strike plate with real cleat means, to form a unitary structure 14*b*, which could be incorporated into, and improve prior art designs, is shown. Unitary structure 14*b* allows for the self-cleaning benefits previously described to be incorporated into the prior art designs. Unitary structure 14*b* would be most useful in a prior art design incorporating a rigid substrate means 12*a*, wherein cleat members 18*b* depend downward through the surface of rigid substrate means 12*a*. Unitary structure 14*b* could also be used with rubberized decking material, but substantial rigidity would be lost, and therefore a rigid substrate means 12*a* is preferred for use with unitary structure 14*b*. In FIG. 5, unitary structure 14*b* has rows of upward-depending projections 38*a*, which comprise a self-cleaning and gripping surface as previously described. Alternately, as shown FIG. 6, projections 38*a* could be eliminated in favor of placing bumps or ridges 42 upon face 37*a*, to serve as a self-cleaning surface. By combining unitary structure 14*b* with a rigid substrate means 12*a*, an adequately rigid rear cleat assembly 10*b* is completed, which does not require the use of a secondary decking patch 30, or a heel plate 32 as seen previously in FIGS. 2*b*, 3*b* and 4*b*.

Figure 7:
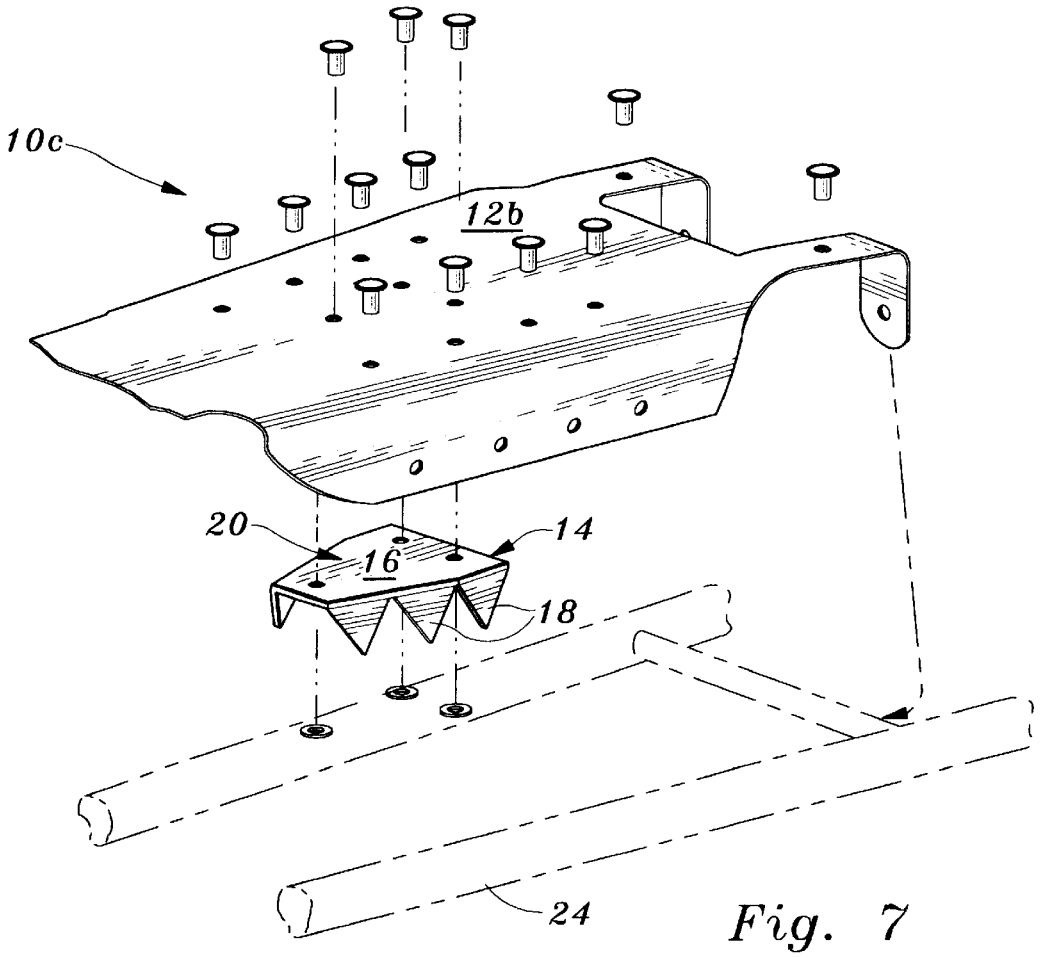
FIG. 7 is an exploded view of the second embodiment of the snowshoe rear cleat assembly which is the present invention.
Figure 8:
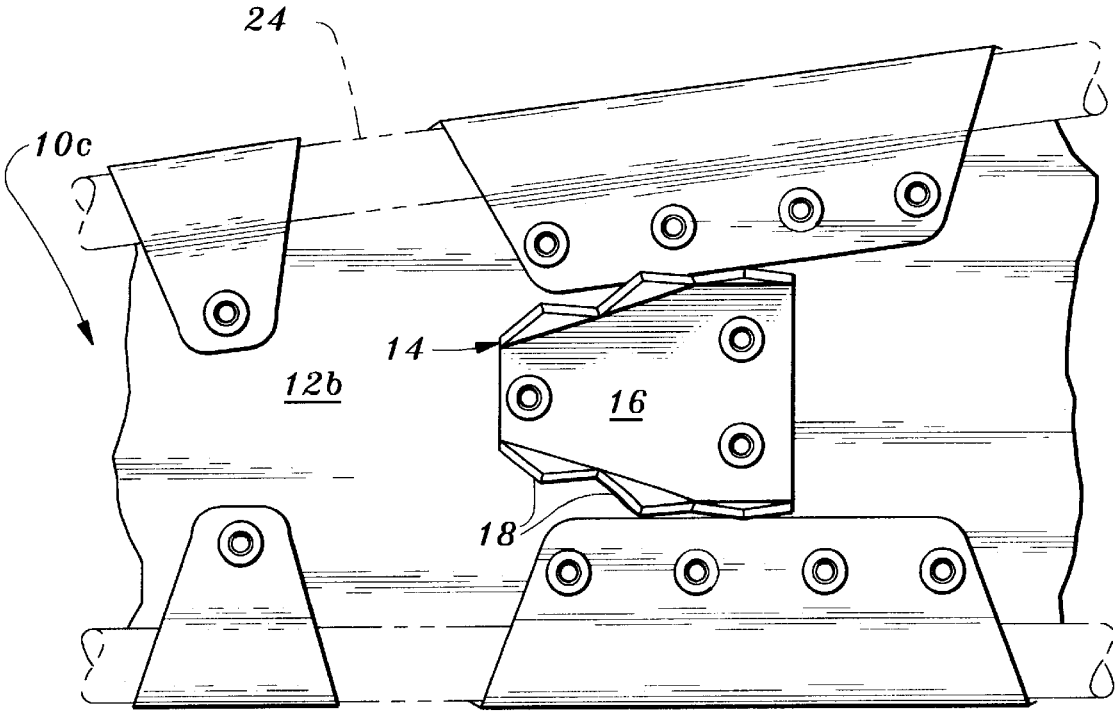
FIG. 8 is a bottom view of the second embodiment shown in FIG. 7.

In a second embodiment of the rear cleat assembly 10*c*, shown in FIGS. 7 and 8, rigid substrate means 12*b* comprises the entire decking of the snowshoe. In this embodiment no rubberized decking material is used, and therefore, the rigid substrate means 12*b* does not underlap a rubberized decking layer, as shown in FIGS. 3*a* and 4*a*. This embodiment also allows direct attachment of rear cleat means 14 beneath rigid substrate means 12*b* without using the "sandwich" structure seen in the prior art in FIGS. 2*b*, 3*b* and 4*b*. Therefore, this embodiment represents an advantage over the prior art in terms of ease of manufacture, because the steps of preparing a secondary decking patch 30, and cutting holes 34 for placing cleat members 18*a* through, are eliminated. However, because this embodiment does not incorporate an underlapping feature into its construction, rear cleat means 14 is elevated higher into frame 24, similar in depth to the prior art rear cleat assembly discussed herein and illustrated in FIGS. 2*b*, 3*b* and 4*b*.

Finally, although the description above contains many specificities, these should not be construed as limiting the scope of the invention, but as merely providing illustrations of some of the presently preferred embodiments of this invention. Thus the scope of this invention should be determined by the appended claims and their legal equivalents.

I claim:

1. A snowshoe, the snowshoe comprising:

a) a frame;

b) a binding, said binding coupled inside of said frame;

c) a decking material, said decking material spanning across said frame;

d) a rigid substrate means for providing a mounting surface for a rear cleat means, said rear cleat means for providing traction to said snowshoe;

e) said rigid substrate means coupled beneath an underside of said decking material;

f) said rigid substrate means, said decking material, and said frame being coupled together into a rigid structural format;

g) said decking material terminating behind said binding at a point down said frame, said rigid substrate means abuttingly underlapping said decking material at a location forward from said termination point, said rigid substrate means further continuing rearward from said termination point a remaining distance to an end of said snowshoe.

* * * * *